US007011074B2

(12) United States Patent
Ikeda et al.

(10) Patent No.: US 7,011,074 B2
(45) Date of Patent: Mar. 14, 2006

(54) THROTTLE CONTROL DEVICES

(75) Inventors: Tsutomu Ikeda, Aichi-ken (JP); Koji Yoshikawa, Aichi-ken (JP); Sunao Kitamura, Aichi (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 10/855,779

(22) Filed: May 28, 2004

(65) Prior Publication Data

US 2004/0244772 A1 Dec. 9, 2004

(30) Foreign Application Priority Data

May 29, 2003 (JP) ..... 2003-152806
Jun. 5, 2003 (JP) ..... 2003-160783

(51) Int. Cl.
*F02D 7/00* (2006.01)

(52) U.S. Cl. ..... 123/399; 123/617

(58) Field of Classification Search ..... 123/399, 123/617, 355; 251/129.11; 324/207.2, 207.25
See application file for complete search history.

(56) References Cited

U.S. PATENT DOCUMENTS 6,407,543 B1 * 6/2002 Hagio et al. ..... 324/207.25
6,498,479 B1 * 12/2002 Hamaoka et al. ..... 324/207.2
6,622,695 B1 * 9/2003 Kondo ..... 123/336
6,646,435 B1 * 11/2003 Nakamura et al. ..... 324/207.25
6,683,429 B1 * 1/2004 Pringle et al. ..... 318/466

FOREIGN PATENT DOCUMENTS

JP 06264777 9/1994
JP 2001289610 10/2001

* cited by examiner

*Primary Examiner*—Mahmoud Gimie
(74) *Attorney, Agent, or Firm*—Dennison, Schultz, Dougherty & MacDonald

(57) ABSTRACT

A sensor for a throttle control device. The throttle control device includes a throttle body. A throttle valve is disposed within an intake air channel defined within the throttle body. A speed or gear reduction mechanism is coupled between a motor and the throttle valve. A sensor detects the rotational position, i.e., the rotational angle, of the motor and has a movable section and a fixed sensing section. The movable section is attached to a rotary shaft of the motor, so that the movable section rotates as the rotary shaft rotates. The fixed sensing section is mounted to the throttle body and is disposed within the movable section. By detecting the rotation of the motor a computing section can accurately determine the degree of opening of the throttle valve. The sensor outputs the degree of opening of the throttle valve.

25 Claims, 13 Drawing Sheets

THROTTLE CONTROL DEVICES

This application claims priorities to Japanese patent application serial numbers 2003-152806 and 2003-160783, the contents of which are incorporated herein by reference.

BACKGROUND OF THE INVENTION

1. Field of the Invention

The present invention relates to throttle control devices that have a motor and a reduction gear mechanism that is driven by the motor in order to rotate a throttle valve for controlling a flow rate of intake air supplied to an engine, e.g., an internal combustion engine of an automobile.

2. Description of the Related Art

Japanese Laid-Open Patent Publication No. 6-264777 teaches a known throttle control device. As shown in FIG. 14, the known throttle control device has a motor 92 and a reduction gear mechanism 94 that is driven by the motor 92 in order to rotate a throttle valve 96 for controlling a flow rate of intake air. A movable section 102 of a throttle sensor 100 is coaxially mounted on one end of a rotary shaft 92*s* of the motor 92. The movable section 102 has a disk-like configuration including concave and convex portions. The concave and convex portions are formed on the outer periphery of the movable section 102 and are arranged at predetermined intervals in the circumferential direction. A fixed sensing section 104 of the throttle sensor 100 is mounted on the throttle body 91 and is adapted to detect the concavity or the convexity of the movable section 102.

Therefore, as the movable section 102 of the throttle sensor 100 rotates together with the rotary shaft 92*s* of the motor 92, the fixed sensing section 104 of the throttle sensor 100 detects the concave or convex portions of the movable section 102 in order to count the number of concave or convex portions moving past the sensing section, so that the rotational angle of the motor 92 and consequently the degree of opening of the throttle valve 96 can be determined. Because the rotational angle of the throttle valve 96 is determined based upon the rotational angle of the motor 92, the accuracy of the measurement of the rotational angle of the throttle valve 92 can be improved in comparison with an arrangement in which the rotational angle of a throttle valve is directly detected.

Here, in order to provide a level of precision for the measurement, the outer diameter of the movable section 102 is set to be substantially equal to the outer diameter of the motor 92.

However, the throttle sensor 100 of the known throttle control device is configured to detect the concave or convex portions formed on the outer periphery of the disk-like movable section 102 and to count the number of the concave or convex portions in order to obtain the rotational angle of the throttle valve 92. Therefore, the throttle sensor 100 must have a large size in a diametrical direction to accommodate the number of concave and convex portions required for accuracy. For this reason, the space for accommodating the motor 92 having the throttle sensor 100 must be large in size in a diametrical direction in comparison with a space required for accommodating only the motor 92. Therefore, a problem has been that the throttle body 91 must also have a relatively large size.

SUMMARY OF THE INVENTION

It is accordingly an object of the present invention to teach improved throttle control devices that are small in size while still providing the ability to accurately detect the degree of opening of the throttle valve based upon the rotational angle of the motor.

According to one aspect of the present teachings, throttle control devices are taught that include a throttle body. A throttle valve is disposed within an intake air channel defined within the throttle body. A speed reduction mechanism, e.g., a reduction gear mechanism, is coupled between a motor, e.g., a DC motor, and the throttle valve, so that the throttle valve is rotated by the motor via the speed reduction mechanism. The rotation of the throttle valve is performed in order to open and close the intake air channel for controlling the flow rate of intake air through the intake air channel. A sensor detects a rotational position, i.e., the rotational angle, of the throttle valve and includes a movable section and a fixed sensing section. The movable section is attached to the rotary shaft of the motor, so that the movable section rotates as the rotary shaft rotates. The fixed sensing section is disposed within the movable section so as to not contact the movable section. The fixed sensing section is mounted to the throttle body via a support member. The motor and the movable section have a first cross sectional area and a second cross sectional area within planes perpendicular to the axial direction of the rotary shaft. The second cross sectional area is equal to or smaller than the first cross sectional area.

Because the sensor detects the rotational position of the throttle valve based upon the rotational position of the motor, the precision can be enhanced by adjusting the reduction ratio (speed reduction ratio) of the reduction gear mechanism (speed reduction mechanism), in comparison with an arrangement in which a sensor directly detects the rotational angle of a throttle valve. Therefore, the rotational position of the throttle valve can be accurately detected without requiring the use of a high-resolution sensor.

In addition, because the cross sectional area of the movable section is equal to or smaller than the cross sectional area of the motor, the space required for accommodating both of the motor and the movable section does not have to be necessarily larger, with respect to a cross sectional area within a plane perpendicular to the axial direction of the rotary shaft, than a space that is designed for accommodating only the motor. Therefore, while the sensor is positioned adjacent to the motor in order to detect the rotational position of the throttle valve based upon the rotational position of the motor, the size of the throttle control device does not have to be as large as in the known configurations.

In another aspect of the present teachings, the motor includes a motor casing that defines the first cross sectional area. The movable section of the sensor includes a tubular member that defines the second cross sectional area. The movable section of the sensor also includes a space for accommodating a portion of the fixed sensing section. The motor casing and the tubular member may have substantially cylindrical outer walls. The tubular member may have an outer diameter that is equal to or less than the outer diameter of the motor casing.

In another aspect of the present teachings, the motor casing has opposite ends in the axial direction of the rotary shaft of the motor, a first casing end and a second casing end. The rotary shaft extends through the motor casing and has a first end and a second end that extend from respective ends of the motor casing. The movable section of the sensor is attached to the first end of the rotary shaft. The second end of the rotary shaft is coupled to the speed reduction mechanism.

In another aspect of the present teachings, the movable section of the sensor further includes a pair of magnets attached to an inner wall of the tubular member. The magnets are positioned to oppose each other across the rotational axis so as to produce a magnetic field. The fixed sensing section is positioned between the magnets and serves to detect the change of direction of the magnetic field produced by the magnets as the movable section rotates. The fixed sensing section then calculates the rotational position of the throttle valve based upon the detected change of direction of the magnetic field. The sensor may have a relatively compact construction.

In another aspect of the present teachings, the fixed sensing section comprises a detecting section and a computing section. The detecting section detects the change in the direction of the magnetic field. As the movable section rotates, the detecting section generates detecting output signals representing the direction of the magnetic field. The computing section calculates the rotational position of the motor based upon the detecting output signals received from the detecting section. The computing section further calculates the rotational position of the throttle valve based upon the incremental rotational angle signal, the number of detecting range cycles representing the rotation of the motor, the maximum amplitude of the incremental rotational angle signal, and a reference value.

In another aspect of the present teachings, the support member includes a sensor connector having at least one sensor terminal. The fixed sensing section is connected to a first external electrical line via the at least one sensor terminal of the sensor connector. Preferably, the fixed sensing section is formed integrally with the sensor connector.

Because the support member includes the sensor connector, it is not necessary to provide a separate sensor connector in addition to the support member. Therefore, the number of parts of the throttle control device can be reduced and the throttle control device may have a relatively compact construction.

In another aspect of the present teachings, the support member further includes a motor connector having at least one motor terminal. The motor has at least one power source terminal that is connected to a second external electrical line via the at least one motor terminal. Therefore, it is not necessary to provide a separate motor connector in addition to the support member.

In another aspect of the present teachings, the support member further includes a power source connector that serves to connect the at least one motor terminal to the at least one power source terminal of the motor. Preferably, the power source connector comprises a recess formed in the support member. At least one terminal plate may be disposed within the recess and may establish contact between the at least one motor terminal and the at least one power source terminal of the motor.

In another aspect of the present teachings, the sensor connector and the motor connector are integrated as a multiple connector formed integrally with the sensing section.

In another aspect of the present teachings, the tubular member of the movable sensor section is made of material that provides shielding for the fixed sensing section against potential noise produced by the motor. Therefore, the fixed sensing section can be protected from interfering electrical noise. For example, the tubular member may be made of a magnetic material.

In another aspect of the present teachings, sensors for use with a throttle control device are taught. The sensor includes a rotational angle detection means operable to output a sensor output signal of the motor. The incremental rotational angle signal changes linearly from a minimum value to a maximum value throughout the detecting range of equal to or less than one revolution of the motor. The incremental rotational angle signal increases in response to an increase in the rotational angle of the motor. The incremental rotational angle signal immediately decreases from a maximum value to a minimum value as the rotational angle completes one detecting range cycle (e.g. one complete revolution for a detecting range of 0° to 360°) and begins another detecting range cycle. The incremental rotational angle signal then increases linearly from the minimum value to the maximum value in further response to an increase of the incremental rotational angle of the new cycle of rotation. Adding means and subtracting means are used to generate a sensor output signal based upon the total rotation of the motor. More specifically, the adding means serves to add a value corresponding to the maximum amplitude of the incremental rotational angle signal to the sensor output signal each time the motor begins a new detecting range cycle of rotation in a forward direction, i.e., the direction opening the throttle valve. The subtracting means is operable to subtract a value corresponding to the maximum amplitude of the incremental rotational angle signal, previously added at the beginning of a new detecting range cycle of rotation. The value is subtracted from the sensor output signal each time the incremental rotational angle signal decreases to a minimum value and the motor continues to rotate into the previous detecting range cycle of rotation, i.e., during the rotation of the motor in a reverse direction or the direction closing the throttle valve.

With this arrangement, the incremental rotational angle detection means generates a signal that changes linearly from a minimum value to a maximum value within a detecting range of equal to or less than one revolution of the motor in response to an increase in the rotational angle of the motor. For example, if the detection range is from 0° to 360°, the incremental rotational angle signal generated by the rotational angle detection means increases in proportion to the change of the rotational position of the motor during one complete revolution. Thus, the incremental rotational angle signal is at a minimum value when the rotational angle of the motor is 0°, and the incremental rotational angle signal is at a maximum value when the rotational angle of the motor is 360°. When the rotational angle of the motor continues in a forward direction to start another detecting range cycle (in this case, another revolution), after the incremental rotational angle signal has reached a maximum value, the incremental rotational angle signal resets to a minimum value at the beginning of the new detecting range cycle. The incremental rotational angle signal then increases toward the maximum value as the rotational angle of the motor increases in the same manner as during the previous cycle. The amplitude of the incremental rotational angle signal, i.e., the difference between the maximum value and the minimum value of the incremental rotational angle signal, is added to the previous sensor output signal each time the incremental rotational angle signal transitions from a maximum value to a minimum value during the rotation of the motor in a forward direction (i.e., for a detection range of 0° to 360°, this occurs each time the motor completes one revolution and begins another revolution during the opening of the throttle valve). Therefore, the sensor output signal generated based upon the incremental rotational angle signal has a substantially linear characteristic even as the motor is rotating through a plurality of detecting range cycles.

In addition, when the incremental rotational angle signal reaches a minimum value during the rotation of the motor in the reverse direction, the amplitude of the incremental rotational angle signal is subtracted from the sensor output signal as the motor begins the previous detecting range cycle of rotation in the reverse direction, closing the throttle valve. Therefore, the sensor output signal can still have a substantially linear characteristic during the reverse rotation of the motor.

In this way, it is possible to obtain the rotational angle of the throttle valve from the corresponding rotational angle of the motor by using a rotational angle detection means that has a detection range of less than or equal to one complete cycle of revolution (360°).

In another aspect of the present teachings, means are provided for storing a reference value for the sensor output signal. The reference value corresponds to the incremental rotational angle signal of the rotation detection means generated when the throttle valve is in a fully closed position.

Therefore, the rotational angle (degree of opening) of the throttle valve can be accurately determined even if the fully closed position of the throttle valve does not correspond to the 0° position of the rotational angle of the motor as determined by the rotational angle detection means.

The sensor output signal may be calculated by the expression "V=Em*N+e−e0", wherein, V is the sensor output signal (voltage), e is the incremental rotational angle signal (voltage) outputted from the rotational angle detection means, Em is the amplitude of the incremental rotational angle signal e, N is an integer representing the number of detecting range cycles of the motor, and e0 is equal to the reference value corresponding to the incremental rotational angle signal when the throttle valve is in a fully closed position.

In another aspect of the present teachings, the sensor includes a movable section and a fixed sensing section. The movable section is attached to the rotary shaft of the motor, so that the movable section rotates as the rotary shaft rotates. The fixed sensing section interacts with the movable section and is mounted to the throttle body. The movable section of the sensor includes a pair of magnets positioned so as to oppose each other across the rotational axis of the motor. The fixed sensing section includes a detecting section, a first computing section, and a second computing section. The detecting section and the first computing section primarily constitutes the rotation detection means. The second computing section constitutes the adding means and the subtracting means. The detection section is positioned between the magnets and arranged and constructed so as to output a signal corresponding to the change of the direction of the magnetic field as the movable section rotates. Thus, the first computing section generates the incremental rotational angle signal based upon the detecting output signal from the detection section. The second computing section generates the sensor output signal based upon the incremental rotational angle signal, the number of detecting range cycles representing the rotation of the motor, the maximum amplitude of the incremental rotational angle signal, and a reference value.

In another aspect of the present teachings, the first computing section and the second computing section are combined as an integrated circuit (IC).

DETAILED DESCRIPTION OF THE INVENTION

Each of the additional features and teachings disclosed above and below may be utilized separately or in conjunction with other features and teachings to provide improved throttle control devices and methods of using such improved throttle control devices. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Figure 5:
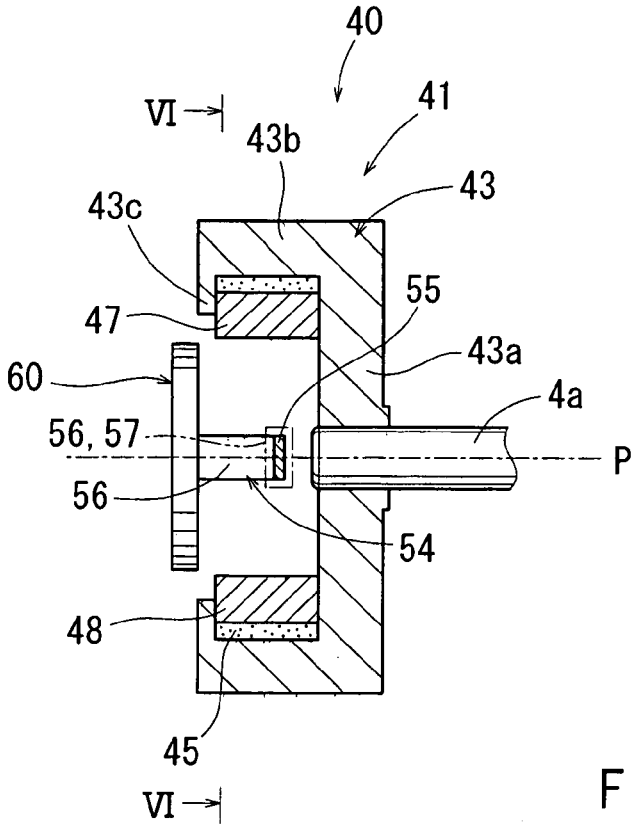
FIG. 5 is a schematic vertical sectional view of a sensor.
Figure 6:
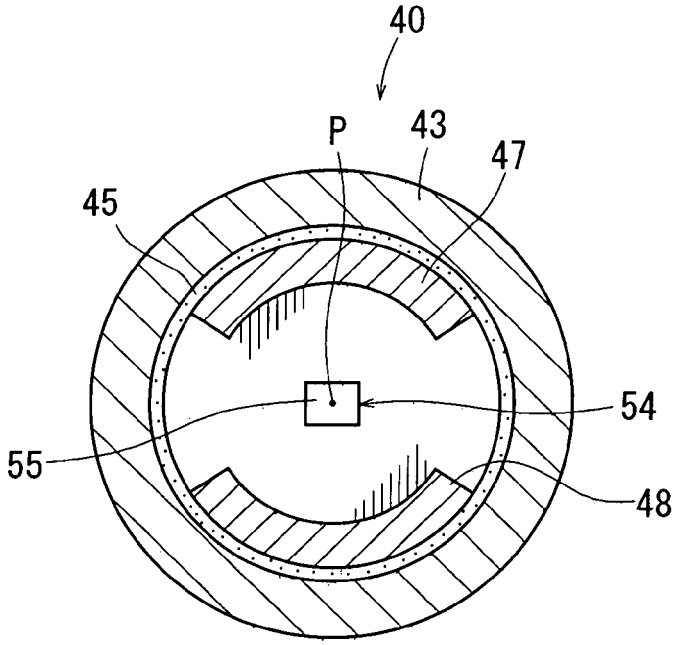
FIG. 6 is a cross sectional view taken along line VI—VI in FIG. 5.
Figure 7:
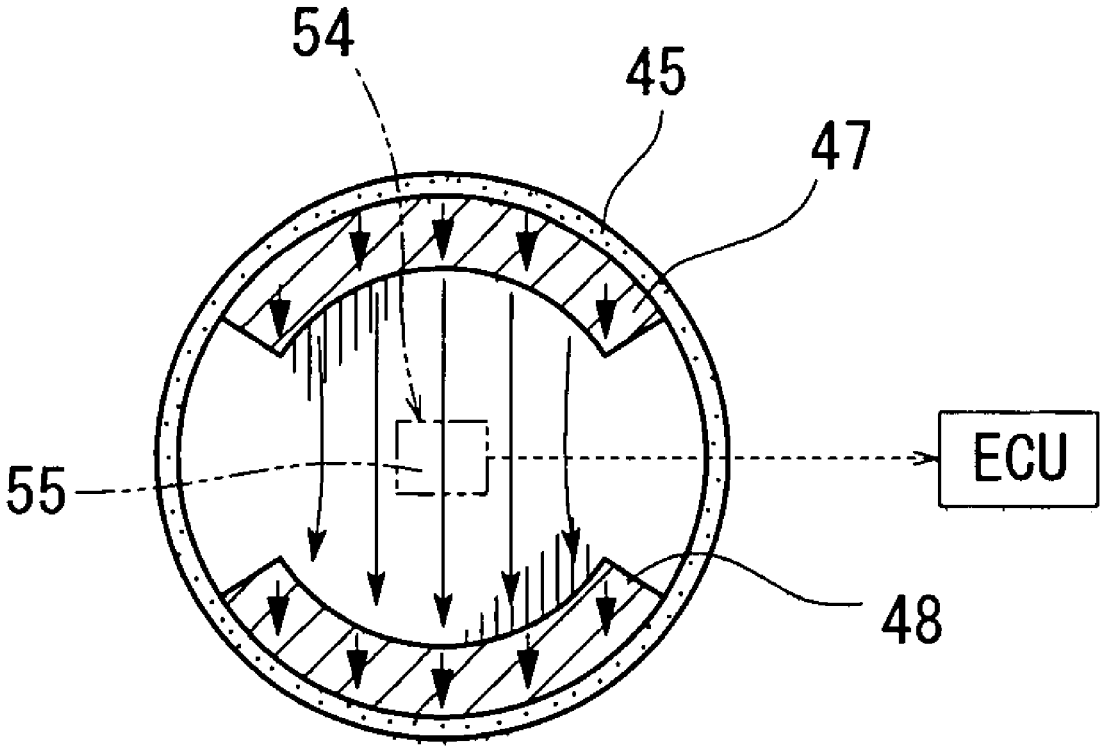
FIG. 7 is a schematic explanatory view illustrating the principle of measurement of the rotational angle by a sensor.

A representative embodiment will now be described with reference to FIGS. 1 to 7. FIGS. 1 to 4 show a representative throttle control device and FIGS. 5 to 7 show a sensor for detecting a rotational angle of a throttle valve of the throttle control device. The representative throttle control device is adapted to control the flow of intake air within an intake system of an internal combustion engine (not shown) and includes a throttle body 1 that may be made of resin, such as PPS.

Figure 1:
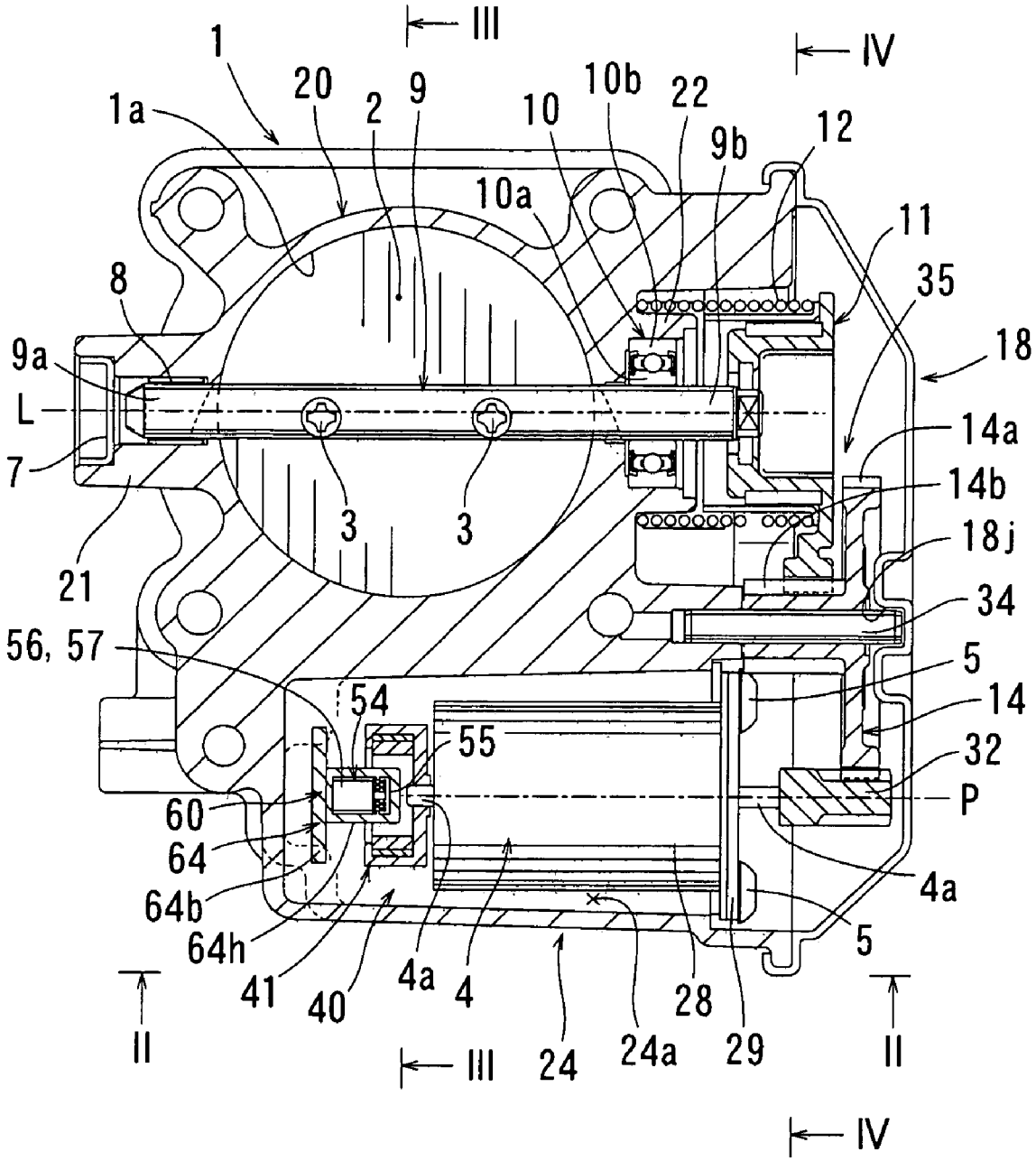
FIG. 1 is a sectional plan view of a representative throttle control device.
Figure 3:
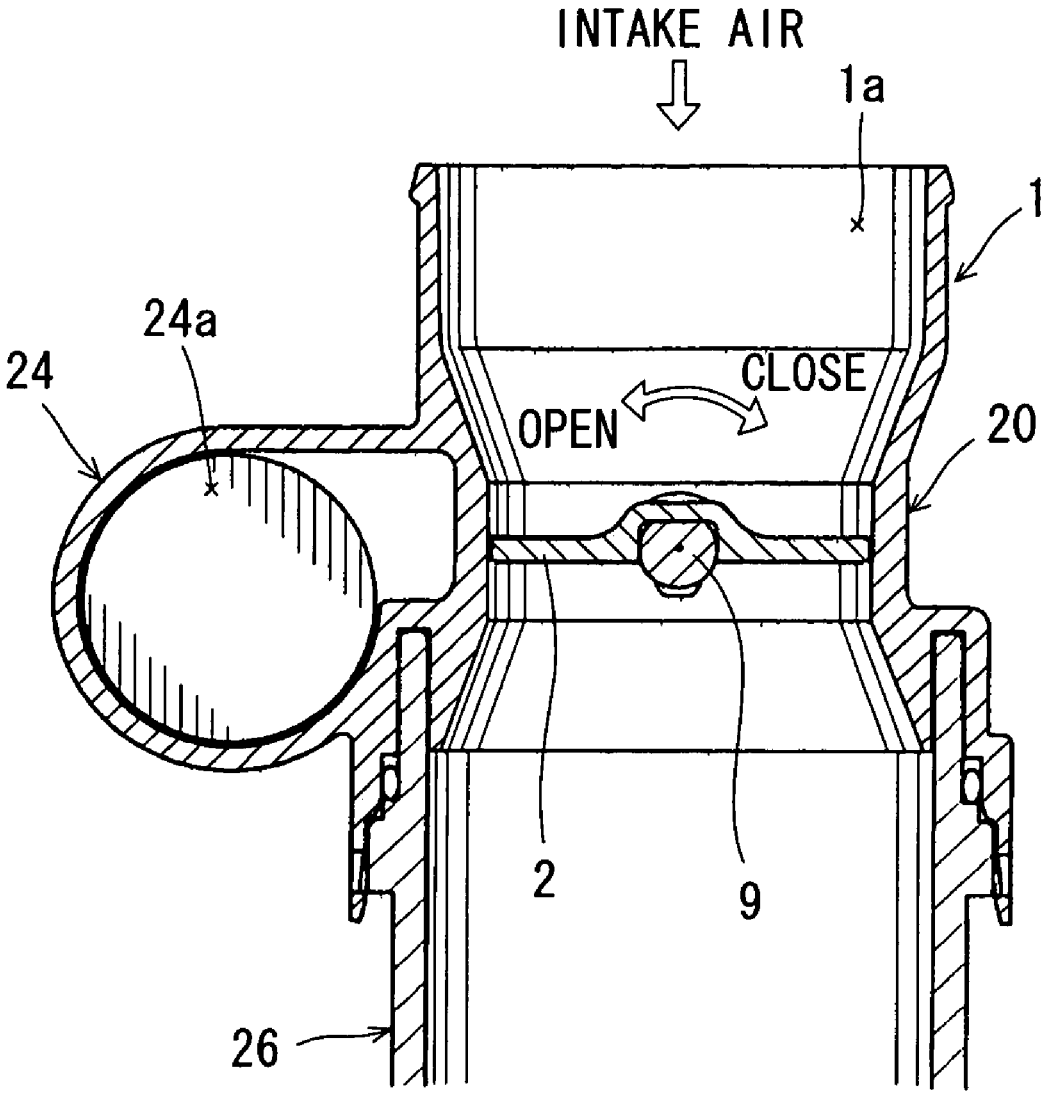
FIG. 3 is a vertical sectional view of a throttle control device, taken along line III—III in FIG. 1.

As shown in FIGS. 1 and 3, the throttle body 1 includes a bore portion 20 and a motor housing portion 24 that are formed integrally with each other. A substantially cylindrical intake air channel 1*a* is formed in the bore portion 20 and extends vertically as viewed in FIG. 3 throughout the bore portion 20. An air cleaner (not shown) is mounted to the upper end of the bore portion 20. An intake manifold 26 (only an upper connecting portion is shown in FIG. 3) is connected to the lower end of the bore portion 20. A throttle shaft 9, preferably made of metal, is mounted to the bore portion 20 and extends across the intake air channel 1*a* in a diametrical direction.

As shown in FIG. 1, a left support portion 21, formed integrally with the bore portion 20, supports a left end 9*a* of the throttle shaft 9 via a left bearing 8. A right support portion 22, also formed integrally with the bore portion 20, supports a right end 9*b* of the throttle shaft 9 via a right bearing 10. Preferably, the left bearing 8 is configured as a thrust bearing and the right bearing 10 is configured as a radial bearing, such as a ball bearing. The throttle shaft 9 is press-fitted into the inner race 10*a* of the right bearing 10. An outer race 10*b* of the right bearing 10 is loosely fitted into the support portion 22 of the throttle body 1. Because the throttle body 1 may be made of resin and the right bearing 10 may be made of metal, the throttle body 1 may include a relatively large tolerance in the size of the inner peripheral surface of the support portion 22 with respect to the right bearing 10. In addition, there is a comparatively large difference in the individual thermal coefficients of linear expansion of the throttle body 1 and the bearing 10. Therefore, if the outer race 10*b* of the bearing 10 were to be press-fitted into the support portion 22, the possibility would exist that the support portion 22 would be cracked during subsequent thermal cycling of the components. However, because the outer race 10*b* of the right bearing 10 is loosely fitted into the support portion 22 of the throttle body 1 in this representative embodiment, the support portion 22 may accommodate thermal cycling with a lower likelihood of being cracked. The tolerances may be experimentally determined or approximated based upon the respective values of the thermal coefficients of expansion of materials used for the throttle body 1 and the right bearing 10.

As shown in FIG. 1, a throttle valve 2, preferably made of resin, is secured or fixed to the throttle shaft 9 via fixing devices, e.g., screws 3, and is disposed within the intake air channel 1*a*. The intake air channel 1*a* can be incrementally opened and closed as the throttle valve 2 rotates with the throttle shaft 9. The throttle shaft 9 is coupled to a motor 4 so that the motor 4 may be driven to adjust the degree of opening of the throttle valve 2, thereby controlling the flow rate of the intake air through the intake air channel 1*a*. The throttle valve 2 is shown in a fully closed position in FIG. 3. The throttle valve 2 opens as it rotates in a counterclockwise direction as viewed in FIG. 3 ("OPEN" direction indicated in FIG. 3).

As shown in FIG. 1, a plug 7 is fitted into the left support portion 21 that supports the left end 9*a* of the throttle shaft 9. The plug 7 conceals the left end 9*a* within the bore 20. The right end 9*b* of the throttle shaft 9 extends through and beyond the support portion 22. A throttle gear 11, preferably made of resin, is configured as a sector gear and is mounted to the extended right end 9*b* of the throttle shaft 9. The throttle gear 11 is fixed so as to not rotate relative to the throttle shaft 9 (see FIGS. 1 and 4). As shown in FIG. 1 a back spring 12, configured as a torsion spring, is interposed between the throttle body 1 and the throttle gear 11. The back spring 12 biases the throttle valve 2 as well as the throttle shaft 9 in the closing direction of the throttle valve 2. Although not shown in the drawings, a stopper is provided between the throttle body 1 and the throttle gear 11 in order to prevent the throttle valve 2 from rotating beyond a predetermined close position, e.g., the fully closed position.

As shown in FIG. 1, the motor housing portion 24 of the throttle body 1 has a substantially tubular cylindrical configuration with a closed end. The motor housing portion 24 has a longitudinal axis that is parallel to the rotational axis L of the throttle shaft 9. A motor accommodating space 24*a* is defined within the motor housing portion 24 and is opened to the right side surface of the throttle body 1. The motor 4 is disposed within the motor accommodating space 24*a* and is positioned such that a front end (the right end as viewed in FIG. 1) of the motor 4 is positioned at the open side of the motor accommodating space 24*a*. For example, the motor 4 may be a DC motor. A mount flange 29 is formed on the front end (the right end as viewed in FIG. 1) of a motor casing 28, i.e., the outer casing, of the motor 4. The mount flange 29 is secured to the motor housing 24 via fixing devices, preferably screws 5, so that the motor 4 of the motor casing 28 is fixed into position such that the motor axis P extends parallel to the rotational axis L of the throttle shaft 9.

Figure 4:
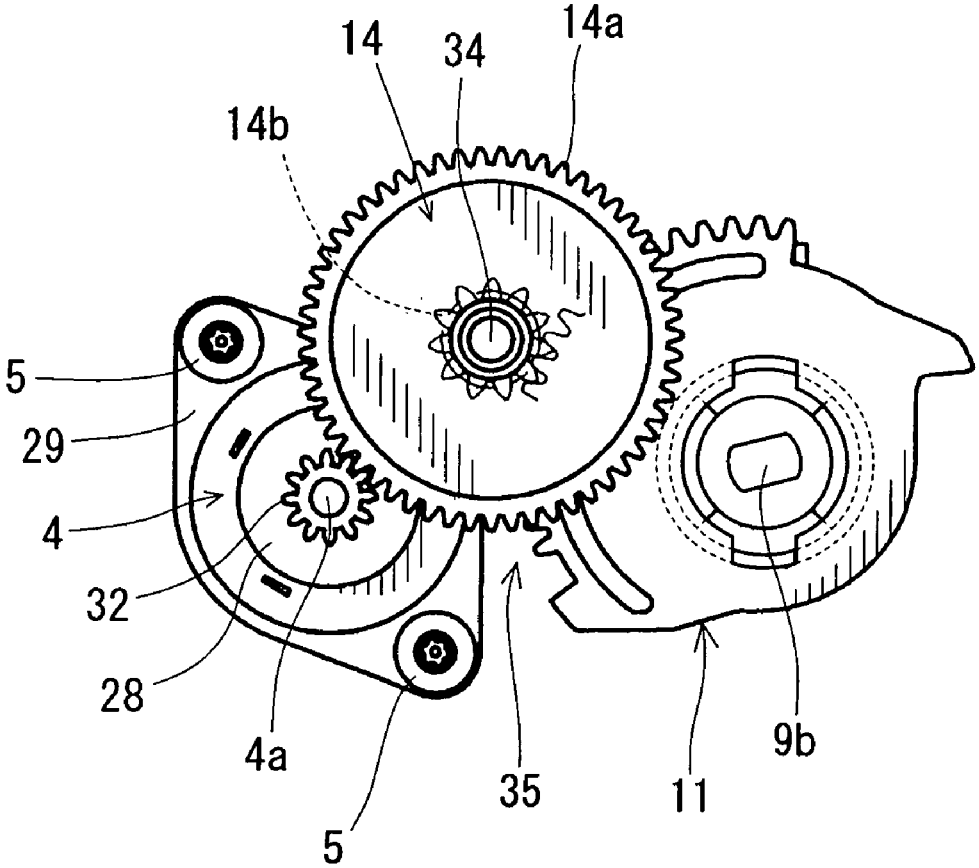
FIG. 4 is a partial front view in a direction indicated by arrows IV—IV in FIG. 1 and showing a front view of a reduction gear mechanism.

As shown in FIGS. 1 and 4, a motor pinion 32 may be made of resin and is mounted to a front part of a rotary shaft, or output shaft 4*a*, of the motor 4. The front part of the motor pinion 32 extends rightward as viewed in FIG. 1 from the front end of the motor casing 28. A countershaft 34 is mounted to the throttle body 1 in an intermediate position between the bore portion 20 and the motor housing portion 24. The countershaft 34 extends parallel to the rotational axis L of the throttle shaft 9. A counter gear 14 is preferably made of resin and is rotatably mounted on the countershaft 34. The counter gear 14 has a large gear portion 14*a* and a small gear portion 14*b*. As shown in FIG. 4, the large gear portion 14*a* engages the motor pinion 32 and the small gear portion 14*b* engages the throttle gear 11. The motor pinion 32, the counter gear 14, and the throttle gear 11, constitute the reduction gear mechanism 35 (speed reduction mechanism).

As shown in FIG. 1, a cover 18 is attached to the right side surface of the throttle body 1 by a suitable coupling means, such as an engaging device, or by crimping the cover 18 to the throttle body 1. The cover 18 is provided in order to cover the reduction gear mechanism 35 and its associated parts. The cover 18 may be made of metal plate, such as an iron plate. A shaft support recess 18*j* may be formed in a position axially opposing the countershaft 34. The right end of the countershaft 34 is rotatably supported by the shaft support recess 18*j*. For example, a press forming operation may form the cover 18 and the shaft supporting recess 18*j*.

Figure 2:
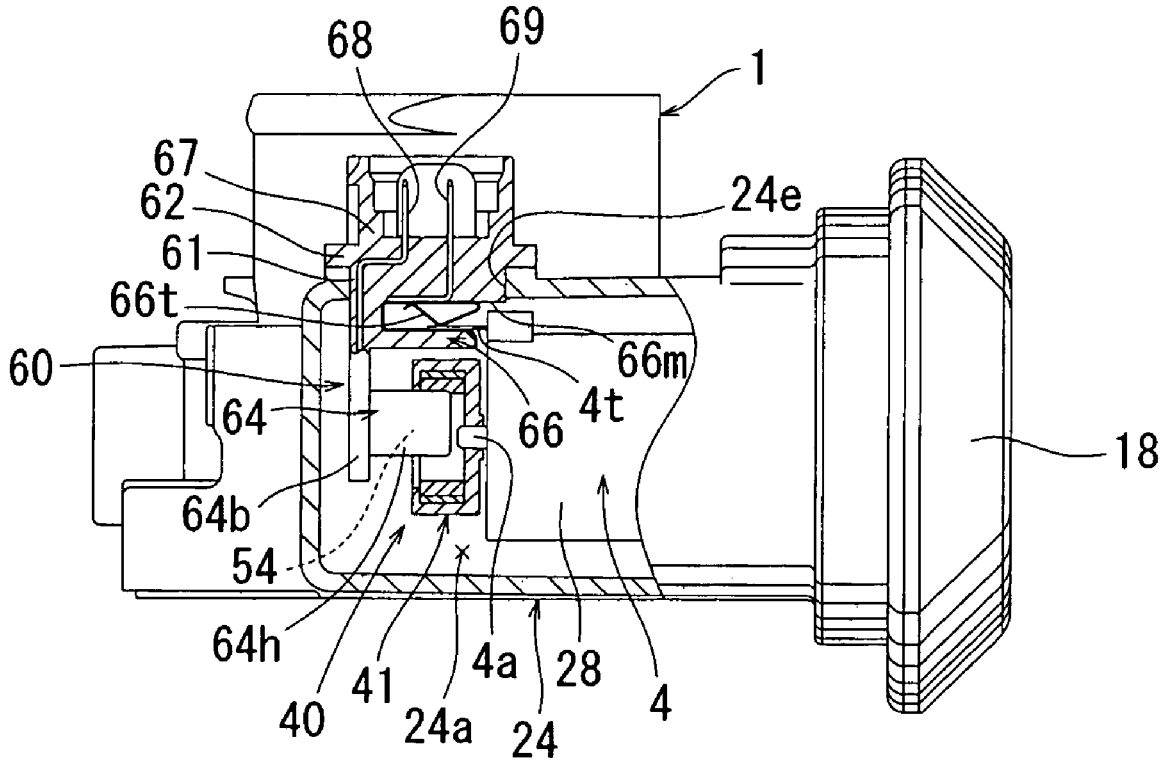
FIG. 2 is a side view, with a portion broken away, of a throttle control device as viewed in a direction indicated by arrows II—II in FIG. 1.

As shown in FIGS. 1, 2, and 5, a sensor 40 has a movable section 41 that is fixed to the rear part of the output shaft 4*a* of the motor 4, which rear part extends rearward (leftward as viewed in FIG. 1) from the rear end of the motor casing 28. Therefore, the movable part 41 has the same rotational axis as the output shaft 4*a* and also rotates with the output shaft 4*a*. As shown in FIG. 5, the movable section 41 includes a substantially cylindrical tubular housing 43, a cylindrical tubular yoke 45, and a pair of magnets, 47 and 48. The housing 43 includes a disk-shaped portion 43*a*, a cylindrical tubular portion 43*b*, and an inner flange 43*c*, so that the housing 43 has a substantially inverted C-shape cross sectional configuration as shown in FIG. 5. Preferably the outer diameter of the housing 43 is set to be considerably smaller than the outer diameter of the motor casing 28 (see FIGS. 1 and 2).

The yoke 45 is made of magnetic material and is disposed within the housing 43 such that the outer surface of the yoke 45 contacts the inner wall 43*b* of the cylindrical tubular portion 43. In addition, the yoke 45 is axially restrained between the disk-shaped portion 43*a* and the inner flange 43*c*. The magnets 47 and 48 are fixedly attached to the inner surface of the yoke 45 such that the magnets 47 and 48 oppose each other. Rotational axis P of the output shaft 4*a* of the motor 4 is positioned in an intermediate position between the magnets 47 and 48. Both axial ends of the yoke 45 and both axial ends of the magnets 47 and 48 are not substantially exposed to the environment outside of the housing 43. Only the inner surfaces of the magnets 47 and 48 are directly exposed to the outside environment of the housing 43. In addition, the magnets 47 and 48 are magnetized so that the magnetic lines of the magnetic field generated between the magnets 47 and 48 extend substantially parallel to each other within the space of the yoke 45 and across the rotational axis P.

Figure 8A:
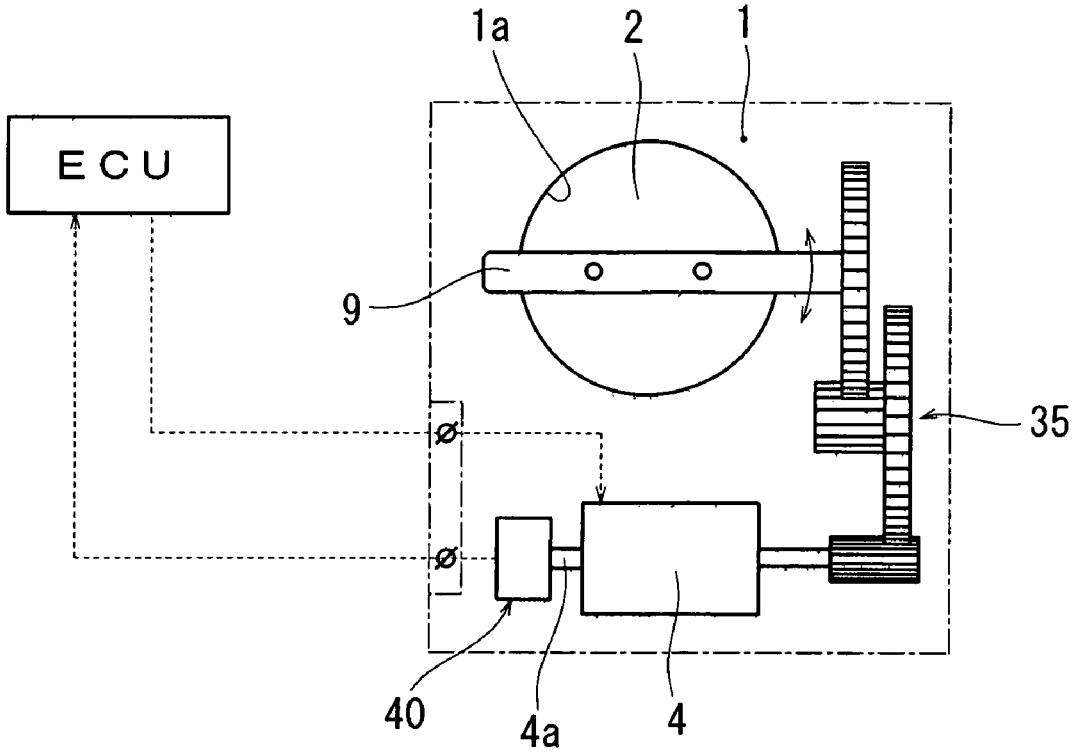
FIG. 8(A) is a schematic view of a throttle control device.
Figure 8B:
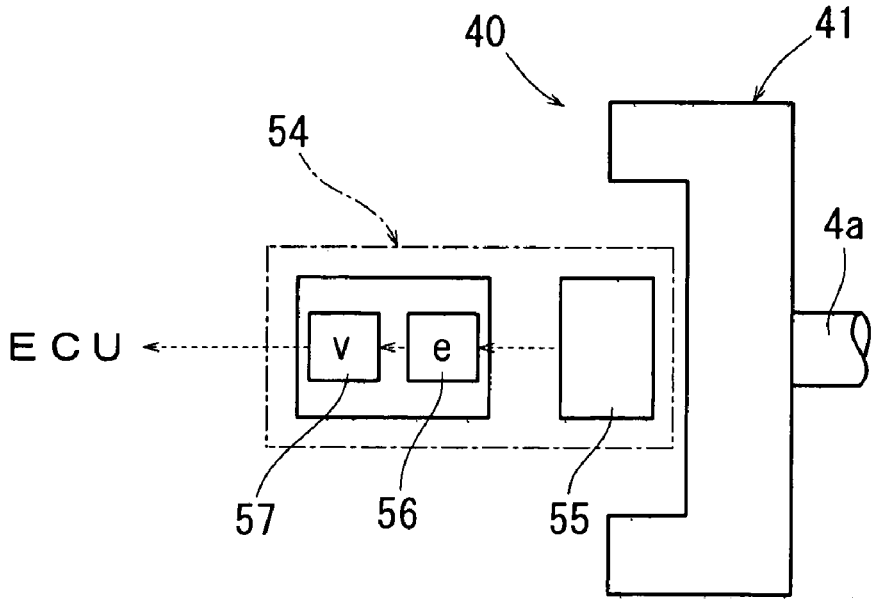
FIG. 8(B) is a schematic view illustrating a general construction of a fixed sensing section of a sensor.

As shown in FIGS. 5 and 6, a fixed section (the sensor body 54) of the sensor 40 is positioned at a predetermined fixed position between the magnets 47 and 48 of the movable section 41. The sensor body 54 is configured to detect a change in the direction or orientation of the magnetic lines of the magnetic field. The change in direction may be caused as the movable section 41 rotates with the output shaft 4*a* of the motor 4. The sensor body 54 then determines the rotational angle of the motor 4 based upon the detected change. More specifically, the sensor body 54 includes a magnetic detection section 55, a first computing section 56, and a second computing section 57 (see FIG. 8(B)). The magnetic detection section 55 serves to detect the change in the direction of the magnetic lines of the magnetic field and to produce a detecting output signal corresponding to the detected direction. The first computing section 56 then calculates the incremental rotational angle (using a detection range of 0° to 360°) of the motor 4 based upon the detecting output signal from the magnetic detection section 55. The second computing section 57 further calculates the rotational angle, i.e., the degree of opening, of the throttle valve 2 based upon the incremental rotational angle of the motor 4, the number of detecting range cycles representing the rotation of the motor, the maximum value or amplitude of the incremental rotational angle, and a reference value.

As shown in FIGS. 5 and 6, the magnetic detection section 55 of the sensor body 54 is positioned between the magnets 47 and 48. The magnetic detection section 55 is also positioned upon the same central axis as magnets 47 and 48. In addition, the magnetic detection section 55 is oriented such that a front surface (end surface) of the magnetic detection section 55 extends substantially perpendicular to the rotational axis P of the output shaft 4*a* of the motor 4 (see FIG. 5). The magnetic detection section 55 of the fixed section (sensor body 54) interacts with the magnetic field generated by the magnets 47 and 48 of the movable section 41. For example, the magnetic detection section 55 may comprise a magnetoresistive element.

The first computing section 56 and the second computing section 57 of the sensor body 54 are integrated as an IC. The second computing section 57 is configured to output a linear voltage signal (hereinafter called "sensor output signal V"), which corresponds to the degree of opening (0° to about 84°) of the throttle valve 2. The sensor output signal V of the second computing section 57, representing the degree of opening of the throttle valve 2, is inputted to a control device such as an ECU (engine control unit) for controlling an internal combustion engine of an automobile (see FIGS. 7, 8(A) and 8(B)).

The sensor body 54 is mounted on a support member 60 that is fixed to the motor housing portion 24 of the throttle body 1. The support member 60 may be made of resin and has a dual function of providing a support for the sensor body 54 and serving as an electrical connector. As shown in FIG. 2, the support member 60 includes a sensor support portion 64 and a motor connector portion 66 that are positioned within the motor accommodating space 24*a*. The support member 60 also includes a multiple connector portion 67 that is positioned outside of the motor housing 24.

A shaft portion 61 is formed on an intermediate position of the support member 60 and is fitted into an opening 24*e* formed in the upper part (as viewed in FIG. 2) of the motor housing portion 24. A flange 62 is formed on the upper side of the shaft 61 and is positioned outside of the motor housing 24. With the shaft portion 61 fitted into the opening 24*e*, the flange 62 is fixed around the opening 24*e* to the outer wall of the motor housing portion 24 by means of fasteners, such as screws, so that the support member 60 is fixed in position relative to the motor housing portion 24.

The sensor support portion 64 of the support member 60 has a base 64*b* and a support plate 64*h*. The base 64*b* is positioned so as to extend perpendicular to the rotational axis P of the output shaft 4*a* of the motor 4. The support plate 64*h* is mounted to the base 64*b* and extends parallel to the rotational axis P. The sensor body 54 is mounted to the support plate 64*h* as shown in FIG. 1.

The motor connector 66 is formed between the sensor support portion 64 and the shaft portion 61. The motor connector 66 is configured to receive a power source terminal 4*t* that extends from the motor 4. The power source terminal 4*t* is configured as a strip plate and extends in parallel to the output shaft 4*a* of the motor 4 by a predetermined distance from the upper rear end of the motor casing 28. In order to receive the power source terminal 4*t*, the motor connector 66 has a recess 66*m* that extends in parallel to the output shaft 4*a* of the motor 4. Terminals 66*t* made of spring material are fitted into the recess 66*m* and are adapted to contact the upper surface of the power source terminal 4*t*, while the power source terminal 4*t* is pressed against the lower surface of the inner wall of the recess 66*m*.

The multiple connector 67 of the support member 60 is configured as a female connector and has a plurality of sensor terminals 68 (only one sensor terminal 68 is shown in FIG. 2) and a plurality of motor terminals 69 (only one motor terminal 69 is shown in FIG. 2). Each of the sensor terminals 68 has a base portion embedded within the support member 60, which base portion has a sensor-side terminal end that is electrically connected to a corresponding terminal of the second computing section 57 of the sensor body 54. Each of the motor terminals 69 has a base portion embedded within the support member 60. Each base portion has a motor-side terminal end that is connected to the corresponding one of the terminals 66*t*. A male connector (not shown) may be coupled to the multiple connector 67. The male connector is electrically connected to the control unit via an electric line (not shown).

The operation of the above representative throttle control device will now be described in connection with control of intake air that is supplied to an internal combustion engine of an automobile. When the driver of the automobile depresses an acceleration pedal, the motor 4 rotates in a forward direction under the control of the control unit (ECU). The rotation of the motor 4 is then transmitted to the throttle shaft 9 via the reduction gear mechanism 35. As a result, the throttle shaft 9 (and consequently the throttle valve 2) rotates in the open direction, so that the intake air channel 1*a* is opened to increase the flow rate of the intake air supplied to the engine. On the other hand, when the driver releases the acceleration pedal, the motor 4 is driven in a reverse direction. As a result, the throttle shaft 9 and the throttle valve 2 rotate in a closing direction to decrease the flow rate of the intake air supplied to the engine.

In the meantime as the motor 4 rotates, the movable section 41, of the rotational angle detection sensor 40 secured to the output shaft 4*a* of the motor 4, also rotates. Therefore, the yoke 45 and the magnets 47 and 48 of the movable section 41 rotate, causing the direction or orientation of the magnetic field (represented by substantially uniform magnetic field lines) to change. The magnetic detection section 55 of the sensor body 54 detects such changes in the direction of the magnetic field. The magnetic detection section 55 then outputs a detecting output signal corresponding to the direction of the magnetic field to the first computing section 56. The first computing section 56 calculates the incremental rotational angle of the motor 4 based upon the detection signal from the detection section 55. The second computing section 57 calculates the rotational angle (degree of opening) of the throttle valve 2 based upon the detected rotational angle of the motor 4, the number of detecting range cycles corresponding to the total rotation of the motor, a reference value, and the maximum value of the detected rotational angle of the motor 4 for a particular detection range. A sensor output signal representing the degree of opening of the throttle valve 2 is fed from the second computing section 57 to the control unit.

Based upon the signals representing the degree of opening of the throttle valve 2, signals representing a travelling speed of the automobile and outputted from a speed sensor (not shown), signals representing the rotational speed of the engine and outputted from a crank angle sensor (not shown), signals representing a depression amount of an accelerator pedal and outputted from an accelerator pedal sensor, signals from an $O_2$ sensor (not shown), and signals from an airflow meter (not shown) among others, the control unit, i.e., the ECU, may serve to adjust and control various parameters such as fuel injection control, correction control of the degree of opening of throttle valve 2, and variable speed control of an automatic transmission.

As described above, according to the representative throttle control device, the rotational angle detection sensor 40 detects the rotational angle (degree of opening) of the throttle valve 2 based upon the rotational angle of the motor 4. Therefore, in comparison with the direct detection of the rotational angle of the throttle valve 2, adjusting the reduction ratio of the reduction gear mechanism 35 may increase the accuracy and precision of the measurable range. As a result, the rotational angle of the throttle valve 2 can be accurately detected without requiring the use of a high-resolution sensor.

In addition, the movable section 41 and the sensor body 54 constitute the rotational angle detection sensor 40. The movable section 41 is coaxially mounted to the output shaft 4*a* of the motor 4. The sensor body 54 is mounted to the throttle body 1 via the support member 60. The sensor body 54 of this embodiment is located within the movable section 41 so as to not have physical contact with the movable section 41. In addition, the outer diameter of the movable section 41 is smaller than the outer diameter of the motor 4, i.e., the outer diameter of the motor casing 28. Therefore, the space required for accommodating the motor 4, and the movable section 41 and the sensor body 54 of the rotational angle detection sensor 40, is not required to be enlarged in the diametrical direction in comparison with the space needed for accommodating only the motor 4. In other words, even if the sensor 40 is disposed adjacent to the motor 4 in order to detect the rotational angle of the throttle valve 2 based upon the rotational angle of the motor 4, the size of the throttle control device may be relatively small.

Further, the support member 60 has a dual function as both a support for the sensor body 54 and as an electrical connector. Therefore, the overall number of parts of the throttle control device may be reduced, allowing the throttle control device to have a compact construction also in this respect.

Furthermore, the yoke 45 of the movable section 41 of the rotational angle sensor 40 may be made of a magnetic material. Therefore, the sensor body 54, disposed inside of the movable section 41, can be shielded from influence by possible noise generated by the motor 4.

The operations of the first and second computing sections 56 and 57 will now be described with reference to flowcharts shown in FIGS. 9 to 11 and schematic views shown in FIGS. 12 and 13. The second computing section 57 performs the processes shown in FIGS. 9 to 11.

When the engine is not started (or power is not supplied to the motor 4), the throttle valve 2 may be held in a slightly opened position (providing an opening angle of less than 5°) by the back spring 12. Once the engine is started in Step 101 of the process shown in FIG. 9, the control unit, i.e., ECU, outputs a control signal to the motor 4 to rotate in a reverse direction, closing the throttle valve. Therefore, the throttle valve 2 may be rotated to a fully closed position against the biasing force of the back spring 12. The process shown in FIG. 9 is then configured to calculate the rotational angle of the throttle valve 2.

The incremental rotational position (rotational angle) of the motor 4 at the fully closed position of the throttle valve 2 is calculated by the first computing section 56 based upon the detection signal from the magnetic detection section 55 of the sensor body 54. The first computing section 56 then outputs a detection signal with a voltage e0 to the second computing section 57. The voltage e0 corresponds to the fully closed position. The second computing section 57 then stores the voltage e0 as a reference voltage of the detecting output signal of the sensing section 54 (Step S102). The process proceeds to Step S103, in which the integer value N representing the number of detecting range cycles corresponding to the rotation of the motor 4 is cleared (N=0).

When the acceleration pedal is depressed, the process proceeds to Step S104, in which the motor 4 rotates in the forward direction in order to open the throttle valve 2, as described previously in connection with the operation of the throttle valve 2. The process moves to Step S105 to perform an open direction control process that reads the detecting output signal of the first computing section 56 of the motor 4 (see Step S111 in FIG. 10). Here, the detecting output signal of the first computing section 56 has a voltage e that corresponds to the rotational position (rotational angle). The voltage e will be hereinafter also called as "incremental rotational angle voltage e".

Figure 12:
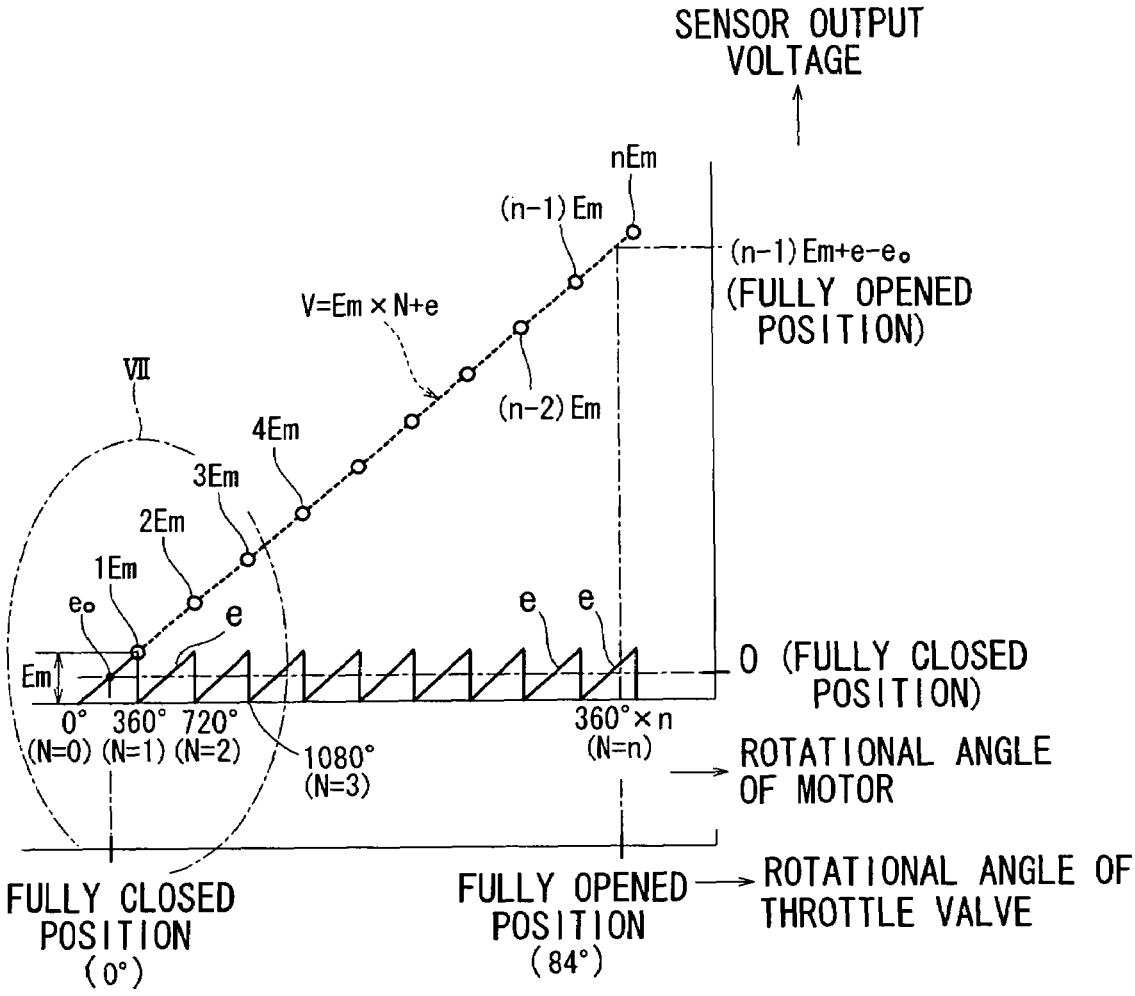
FIG. 12 is a schematic graph illustrating the results of the processes performed by a second computing section.
Figure 13:
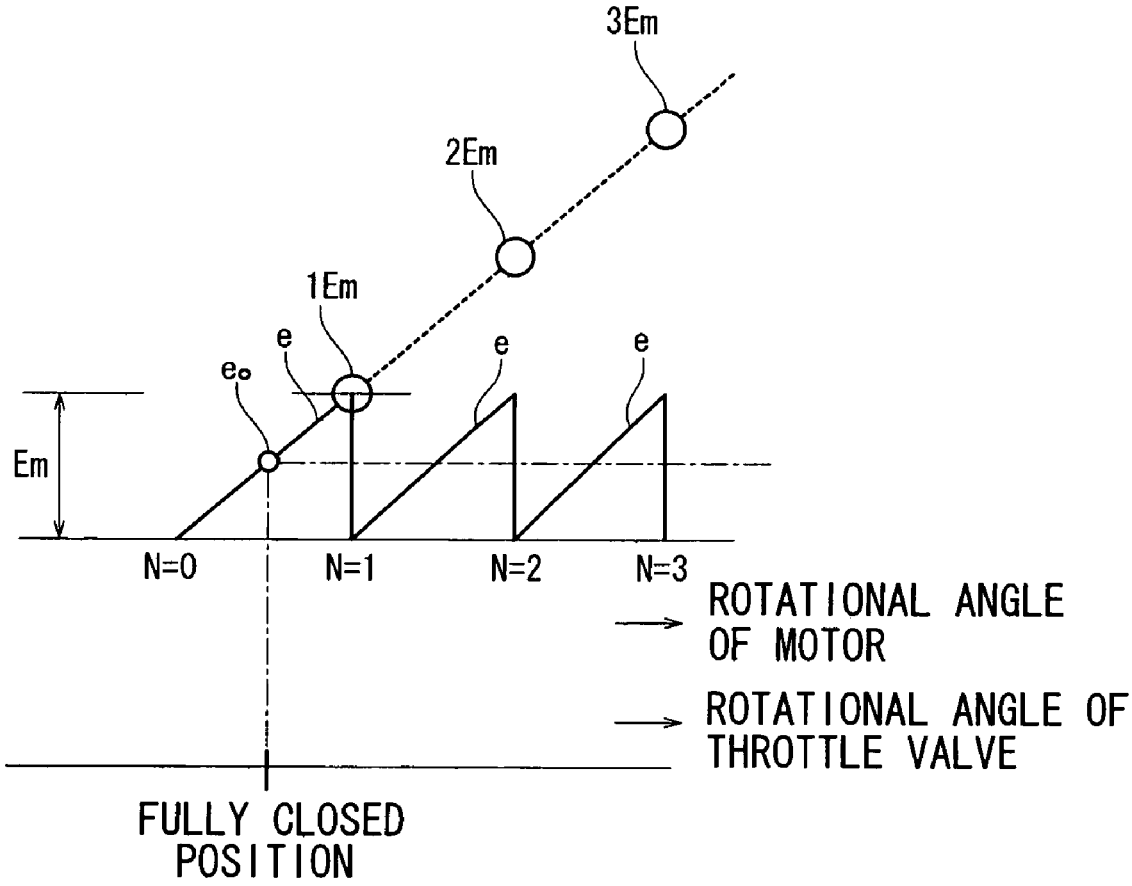
FIG. 13 is an enlarged view of a portion of FIG. 12.
Figure 14:
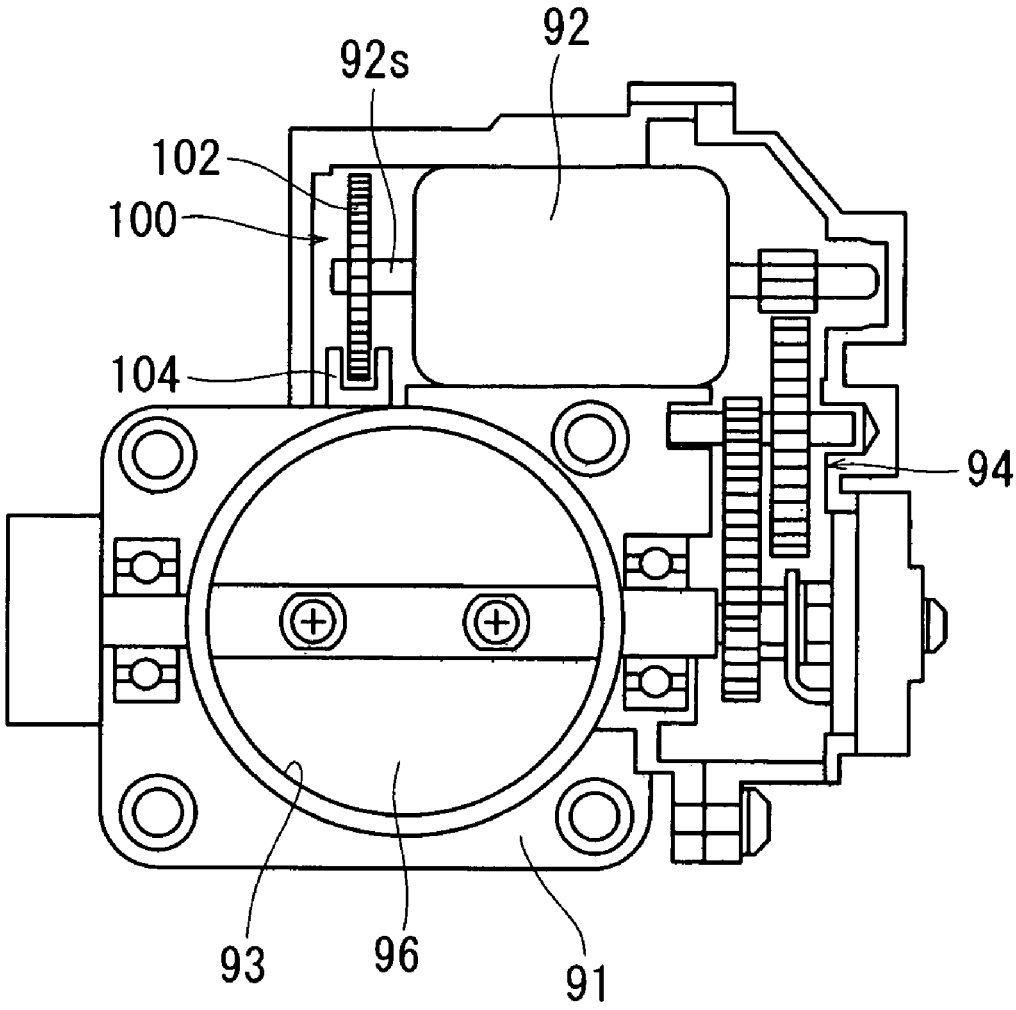
FIG. 14 PRIOR ART
FIG. 14 is a sectional plan view of a known throttle control device.

Because the motor 4 rotates in the forward direction, the incremental rotational angle voltage e increases linearly from the reference voltage e0, as shown in FIGS. 12 and 13. In FIGS. 12 and 13, triangular waveforms indicate the incremental rotational angle voltage e as the motor turns through a plurality of detecting range cycles as the throttle valve 2 is driven to a fully opened position.

At the beginning of rotation of the motor 4 in the forward direction, the incremental rotational angle voltage e is initially smaller than the maximum voltage Em. Therefore, the decision point in Step S112 of FIG. 10 is "NO" (e less than Em) and the process continues to Step S114. In Step S114 the sensor output voltage V is calculated by the expression "V=Em*N+e−e0". Because N is zero (the motor 4 has rotated through less than one complete detecting range cycle), the sensor output voltage V is calculated by the simplified expression "V=e−e0". The voltage "e−e0" is outputted as the sensor output voltage V in Step S115. The resulting sensor output voltage V is indicated by an inclined solid line between 0° and 360° in FIG. 12. Here, "Em" corresponds to the total amplitude of the incremental rotational angle voltage e as shown in FIGS. 12 and 13. In other words, "Em" corresponds to the difference between the maximum value and the minimum value of the voltage e. Because the minimum value is zero, "Em" is equal to the maximum value.

As the motor 4 continues to rotate in the forward direction, the results of calculation of the incremental rotational angle of the motor 4, so calculated by the first computing section 56, eventually reaches 360° (the end of the detection range). At this point, the incremental rotational angle voltage e is equal to the maximum value "Em" and the "YES" branch is taken in Step S112. In Step S113, the integer "1" is added to the integer value N representing the number of detecting range cycles completed by the rotation of the motor 4. As a result, the integer value N is equal to "1."

The sensor output voltage V (=Em*N+e−e0) is calculated in Step S114. Since the integer value N is equal to "1", the sensor output voltage V may be calculated by the simplified expression "V=Em+e−e0". The incremental rotational angle voltage e drops from the maximum value "Em" to a minimum value of "0" as the motor 4 rotates through the end of the first detecting range cycle and into the beginning of the second detecting range cycle. Therefore, the initial calculation of the sensor output voltage V of the second detecting range cycle may be represented by the simplified expression "V=Em−e0" (N=1 and e=0).

As the motor 4 continues to rotate in the forward direction beyond the beginning of the second detecting range cycle (for this embodiment, beyond 360°), the flowchart repeats from Step S111 to Step S115 via Steps S112 and S114 (while e<Em). The sensor output voltage V is outputted as "Em+e−e0" (N=1 during the second detecting range cycle, see the inclined dotted line between 360° and 720° in FIG. 12). When the incremental rotational angle voltage e has reached the maximum value "Em", the determination of Step S112 is again "YES", causing "1" to be further added to the integer value N in Step S113. The resulting integer value N is then equal to the integer value "2." The sensor output voltage V from this point forward is calculated in Step S114 from the expression "V=N*Em+e−e0", where N=2. As the rotation of the motor 4 transfers from the end of the second detecting range cycle to the beginning of the third detecting range cycle, the rotational angle representing voltage e changes from a maximum value "Em" to a minimum value of "0". Therefore, immediately after "1" has been added to the integer value N, the sensor output voltage V may be represented by the expression "V=2Em−e0" (N=2, e-0). As the motor 4 further rotates in the forward direction, the process again repeats from Step S111 to Step S115 via Steps S112 and S114. Consequently, the sensor output voltage V is outputted as "2*Em+e−e0"(N=2, see the inclined dotted line between 720° and 1080° in FIG. 12).

In the same manner as described above, "3*Em+e−e0" is outputted as the sensor output voltage V during the fourth detecting range cycle of the motor 4, and "4*Em+e−e0" is outputted as the sensor output voltage V during the fifth detecting range cycle of the motor 4. Therefore, "(n−1)*Em+e−e0" is outputted as the sensor output voltage V during the $n^{th}$ detecting range cycle of the motor 4. Even if the motor 4 must go through a plurality of detecting range cycles as the throttle valve 2 rotates from the fully closed position (0°) to the fully opened position (84° in this embodiment), the sensor output signals V changes linearly in proportion to the rotation of the throttle valve 2 (see the inclined dotted line in FIGS. 12 and 13). In this way, the second computing section 57 of the sensor body 54 (which performs Steps S111, S112, S114 and S115) serves as an adding means for adding the value "Em" to the sensor output voltage V each time the incremental rotational angle signal e reaches a maximum.

Next, if the depression of the acceleration pedal has been released during the fourth detecting range cycle of the motor 4 (N=3), where "3*Em+e−e0" is outputted as the sensor output voltage V, the control unit, i.e., ECU, controls the motor 4 to rotate in the reverse direction. As the motor 4 rotates in the reverse direction, the throttle valve 2 rotates in the closing direction. The determination in Step S104 is "NO" and the process proceeds to Step S106, the close direction control process. The second computing section 57 of the sensor body 54 then performs the close direction control process shown in FIG. 11.

Figure 11:
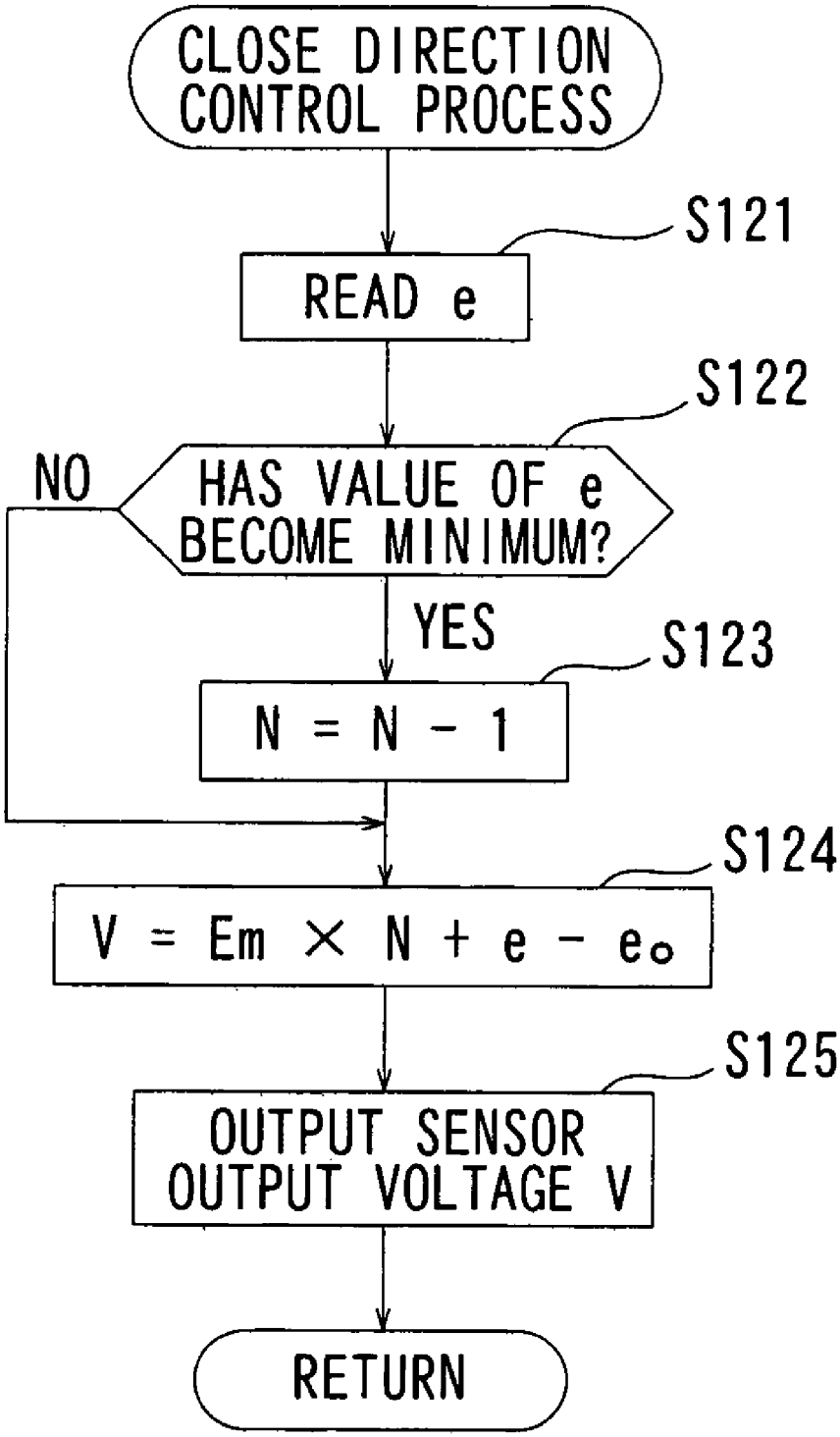

As shown in FIG. 11, the detecting output signal of the first computing section 56, i.e., the incremental rotational angle voltage e, is read in Step S121. The process proceeds to Step S122 and at this point if the sensor output voltage V has a value between "3Em" and "4Em", the incremental rotational angle voltage e is greater than the minimum value (O volt) and the determination in Step S122 is "NO". The process then proceeds from Step S122 to Step S124, in which the sensor output voltage V is calculated from the expression "V=N*Em+e−e0." However, since the integer value N is 3 at this moment, the sensor output voltage V can be calculated from the reduced expression "V=3*Em+e−e0." The calculated sensor output voltage V is outputted in Step S125.

When the calculated angle of the motor 4 at the first computing section 56 has reached 0° as a result of the rotation of the motor 4 in the reverse direction, the determination in Step S121 is "YES". In Step S123, the integer "1" is subtracted from the integer value N representing the number of detecting range cycles of the motor 4 so that the resulting value of N is equal to 2.

Next, the sensor output voltage V is calculated from the expression "V=Em*N+e−e0". Since the integer value N is equal to 2 at this moment, the sensor output voltage V can be calculated from the reduced expression "V=2*Em+e−e0". Also as the motor 4 rotates from the fourth detecting range cycle to the third detecting range cycle, the incremental rotational angle voltage e increases from a minimum value (O volt) to a maximum value (Em volt). Therefore, immediately after "1" has been subtracted from the integer value N, the sensor output voltage V has a value calculated by the expression "V=2*Em+Em−e0" (N=2, e=Em). As the motor 4 further rotates in the reverse direction, the process repeats from Step S121 to Step S125 via Steps S122 and S124, so that the outputted sensor output voltage V is calculated by "2*Em+e−e0" (see the inclined dotted line between 720° to 1080°).

Similarly, the sensor output voltage V is represented by "Em+e−e0" (N=1) when the motor 4 is rotating between during the second detecting range cycle. The sensor output voltage V is represented by "e−e0" (N=0) when the motor 4 is turning within the first detecting range cycle. Therefore, the sensor output voltage V changes linearly in proportion to the rotation of the throttle valve 2, even if the motor 4 must be rotated through a plurality of detecting range cycles in the reverse direction in order to drive the throttle valve 2 from the fully opened position (about 84°) to the fully closed position (0°). The second computing section 57 of the sensor body 54, which performs Steps S122, S123, S124, and S125, serves as a subtracting means for subtracting the value of "Em" from the sensor output voltage V each time that the incremental rotational angle signal e becomes a minimum (0) while the motor 4 is rotating in the reverse direction.

Figure 9:
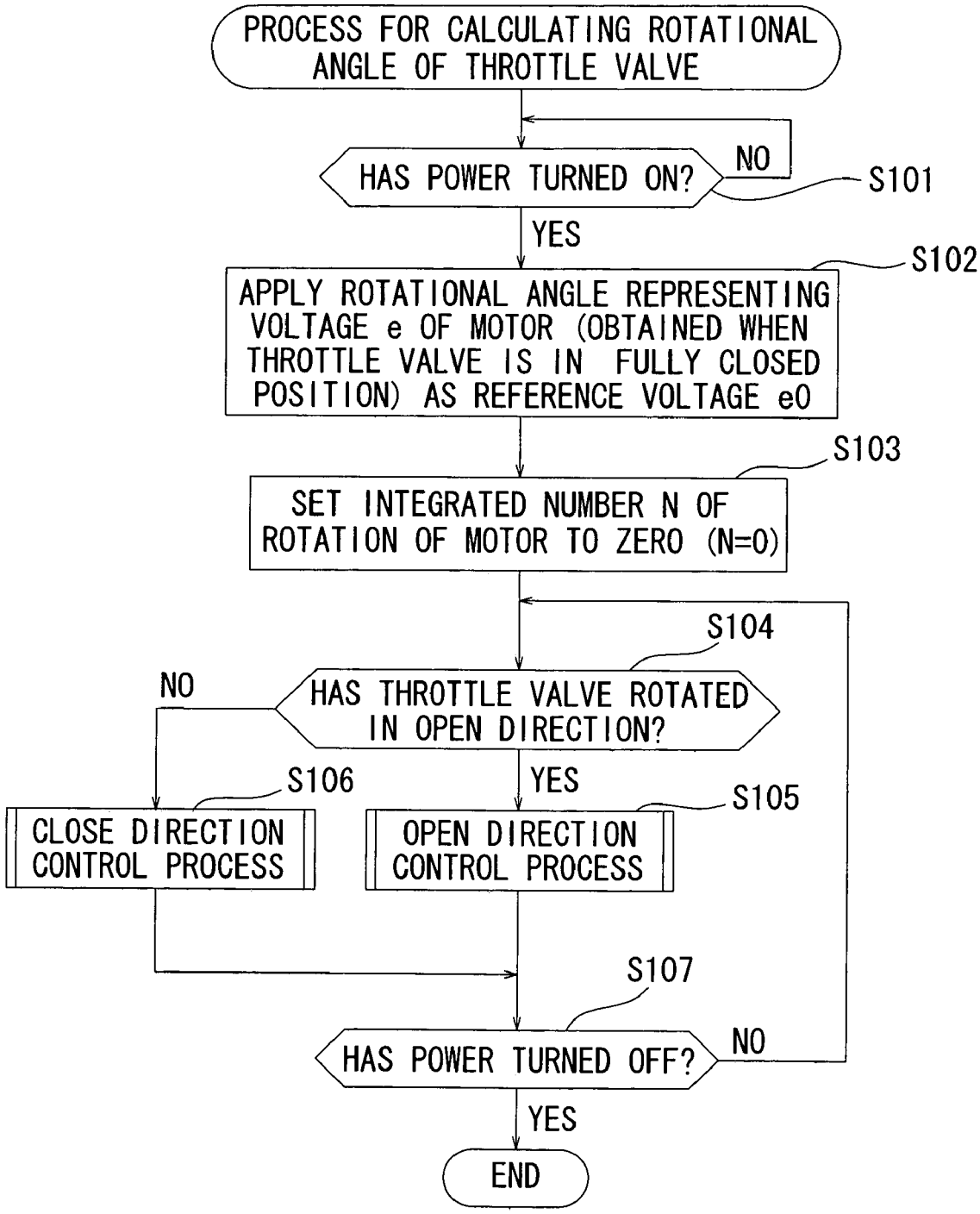
FIGS. 9 to 11 are flowcharts of various processes performed by a second computing section of a sensor.
Figure 10:
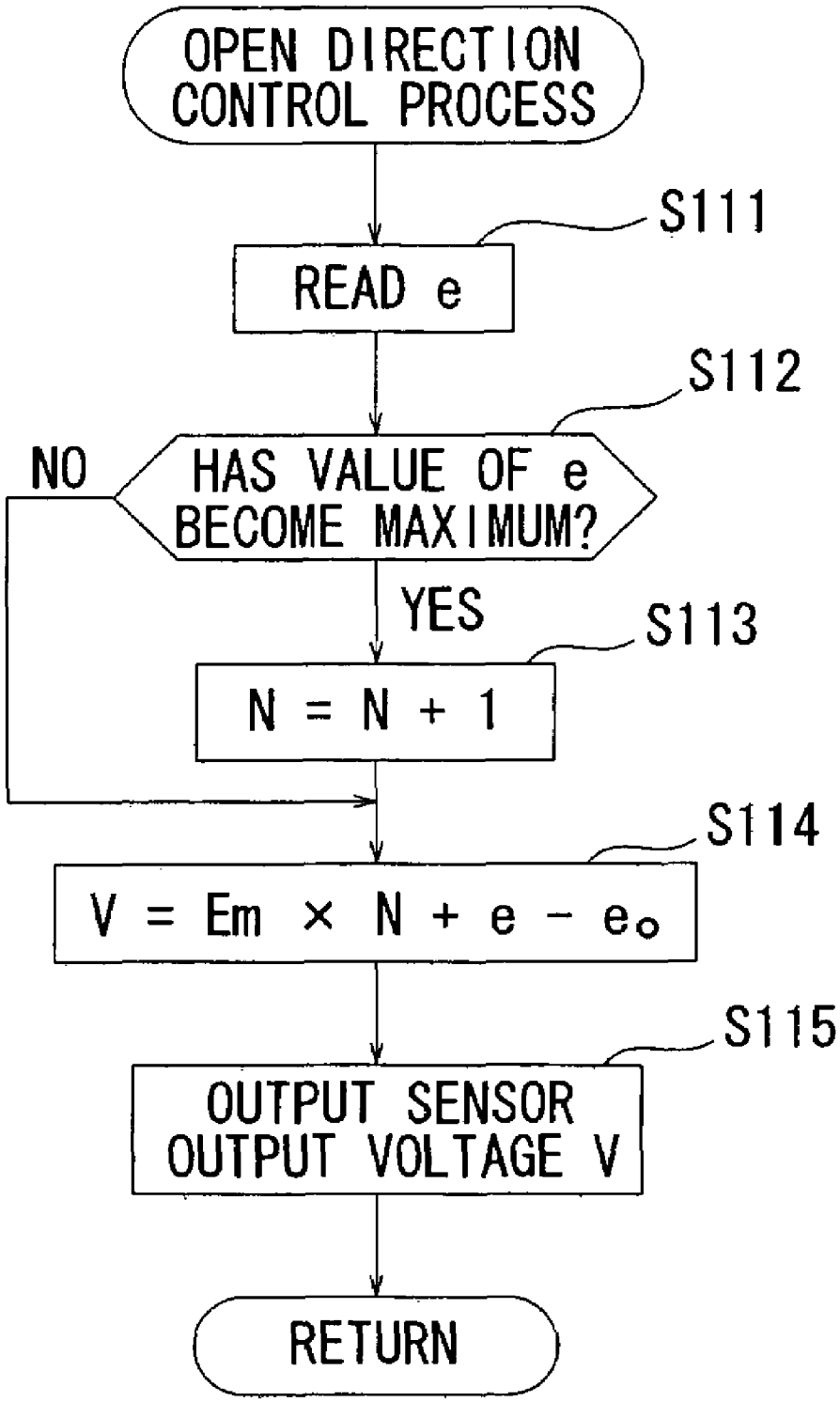

The process shown in FIG. 9 terminates when the engine is stopped, i.e., when the supply of power to the motor 4 is stopped (see Step S107).

As described above, the sensor 40 of this representative embodiment can determine the rotational angle of the throttle valve 2. The sensor 40 determines the angle based in part upon the rotational angle of the motor 4 by using the detecting section 55, having a detection range between 0° and 360°. Therefore, a detecting section having a relatively low resolution or precision can be used as the detecting section while still allowing the sensor to accurately determine the rotational angle of the throttle valve 2.

In addition, the output voltage e0, generated by the first computing section 56 when the throttle valve 2 has returned to a fully closed position, is stored as a reference voltage in the second computing section 57. Therefore, the rotational angle (open angle) of the throttle valve 2 can be calculated accurately even if the fully closed position of the throttle valve 2 has been offset from the 0° position of the rotational angle detection sensor 40 of the motor 4.

The present invention may not be limited to the above representative embodiment but may be modified in various ways. For example, although the throttle body 1 and the throttle valve 2 may preferably be made of resin, they may also be made of metal, such as aluminum alloy. In addition, although the cover 18 may preferably be made of metal, the cover may be made of resin. Further, although the magnetic detection section 55 of the rotational angle detection sensor 40 may preferably include a magnetoresistive element, the magnetoresistive element may be replaced with any other type of sensor element, such as a Hall element, as long as such sensor elements can detect the strength and/or direction of the magnetic field (magnetic lines) produced between the magnets 47 and 48.

Furthermore, although the operations of the sensor 40 has been described in connection with the situation where the fully closed position of the throttle valve 2 is offset from the 0° position of the rotational angle of the motor 4, the sensor 40 also may be applied to the situation where the fully closed position of the throttle valve 2 coincides with the 0° position of the rotational angle of the motor 4. In such a situation, the sensor output signal V may be calculated from the simplified expression "V=Em*N+e."

Still further, although the sensor 40 of the representative embodiment determines the rotational angle of the throttle valve 2 based upon the rotational angle of the motor 4 by using the detecting section 55 that has a detection range between 0° and 360°, a detection section having a smaller detection range, e.g., for example a detection range between 0° and 180°, can also be used. In cases where a smaller detection range is used, the integer value N will represent the number of successive detecting range cycles measured by the detecting section, e.g. for a detection range between 0° and 180°, 2 detecting range cycles will be measured for each complete revolution of the motor.

What is claimed is:

1. A throttle control device comprising:

a throttle body defining an intake air channel;

a throttle valve disposed within the intake air channel;

a motor having a rotary shaft rotatable about a rotational axis;

a speed reduction mechanism coupled between the motor and the throttle valve, so that the throttle valve is rotated by the motor via the speed reduction mechanism, a sensor arranged and constructed to detect a rotational position of the motor, the sensor comprising:

a movable section attached to the rotary shaft of the motor, so that the movable section rotates as the rotary shaft rotates, and a fixed sensing section interacting with the movable section and mounted to the throttle body; and wherein a rotational position of the throttle valve is determined using an incremental rotational angle signal, a number of detecting range cycles representing a rotation of the motor, a maximum amplitude of the incremental rotational angle signal, and a reference value, and wherein a sensor output signal is generated corresponding to the rotational position of the throttle valve.

2. The throttle control device as in claim 1, wherein:

the motor includes a motor casing that defines a first cross sectional area perpendicular to the axis of rotation; and the movable section of the sensor includes a tubular member that defines a second cross sectional area perpendicular to the axis of rotation; and wherein the tubular member includes a space for receiving at least a part of the fixed sensing section, and wherein the second cross sectional area is less than or equal to the first cross sectional area.

3. The throttle control device as in claim 2, wherein each of the first cross sectional area and the second cross sectional area has a substantially cylindrical outer circumference.

4. The throttle control device as in claim 2, wherein the motor casing further comprises;

a first casing end in the axial direction of the rotary shaft of the motor; and a second casing end in the axial direction of the rotary shaft of the motor, and wherein the first casing end is opposite the second casing end; and wherein the rotary shaft extends through the motor casing and further comprises;

a first end extending through the first casing end, and a second end extending through the second casing end, and wherein the movable section of the sensor is attached to the first end of the rotary shaft, and wherein the second end of the rotary shaft is coupled to the speed reduction mechanism.

5. The throttle control device as in claim 2, wherein the movable section of the sensor comprises;

a pair of magnets attached to an inner wall of the tubular member, and wherein the pair of magnets are positioned so as to oppose each other across the rotational axis of the motor; and wherein the pair of magnets are positioned so as to generate a magnetic field represented by substantially uniform magnetic field lines across the fixed sensing section, and wherein the fixed sensing section is positioned between the magnets and arranged and constructed so as to detect the change of direction of the magnetic field as the movable section rotates, and wherein the fixed sensing section generates a detecting output signal.

6. The throttle control device as in claim 5, wherein the fixed sensing section comprises;

a detecting section, and a computing section; and wherein the detecting section detects the change of direction of the magnetic field and outputs detecting signals representing the direction of the magnetic field as the movable section rotates, and wherein the computing section calculates the incremental rotational position of the motor based upon the detecting signals from the detecting section and further calculates the rotational position of the throttle valve, and wherein the calculated rotational position of the throttle valve is the sensor output signal.

7. The throttle control device as in claim 5, further comprising:

a support member comprising:

a sensor connector having at least one sensor terminal, and wherein the fixed sensing section is mounted to the throttle body via the support member, and wherein the fixed sensing section is connected to a first external electrical line via the at least one sensor terminal of the sensor connector.

8. The throttle control device as in claim 7, wherein the fixed sensing section is formed integrally with the sensor connector.

9. The throttle control device as in claim 7, wherein the support member further comprises:

a motor connector having at least one motor terminal, and wherein the motor has at least one power source terminal that is connected to a second external electrical line via the at least one motor terminal.

10. The throttle control device as in claim 9, wherein the support member further comprises:

a power source connector arranged and constructed to connect the at least one motor terminal to the at least one power source terminal of the motor.

11. The throttle control device as in claim 10, wherein the power source connector comprises:

a recess formed in the support member, and at least one terminal plate disposed within the recess, and wherein the power source connector is arranged and constructed to contact with the at least one motor terminal and with the at least one power source terminal of the motor.

12. The throttle control device as in claim 9, wherein the sensor connector and the motor connector are integrated as a multiple connector that is formed integrally with the fixed sensing section.

13. The throttle control device as in claim 2, wherein the tubular member is made of a material that acts as at least a partial shield inhibiting possible electrical noise generated by the motor from adversely affecting the fixed sensing section.

14. The throttle control device as in claim 13, wherein the tubular member is made of a magnetic material.

15. The throttle control device as in claim 1, wherein the sensor comprises:

a rotational angle detection means generating an incremental rotational angle signal that increases linearly from a minimum value to a maximum value within a detection range equal to or less than one forward revolution of the rotary shaft of the motor; and adding means for incrementing a number of detecting range cycles of the motor during the forward rotation of the motor, and subtracting means for decrementing the number of detecting range cycles of the motor during reverse rotation of the motor; and wherein continued forward rotation of the motor causes the incremental rotational angle signal to immediately decrease to the minimum value after reaching the maximum value;

wherein the adding means is operable to generate the sensor output signal by adding a value corresponding to an amplitude of the incremental rotational angle signal to the sensor output signal when the incremental rotational angle signal equals the maximum value during the rotation of the rotary shaft in a forward direction; and wherein the subtracting means is operable to generate the sensor output signal by subtracting the value corresponding to the amplitude (Em) from the previous sensor output signal when the incremental rotational angle signal equals the minimum value during the rotation of the rotary shaft in a reverse direction.

16. The throttle control device as in claim 15, further including means for storing a reference value of the incremental rotational angle signal, wherein the reference value corresponds to the incremental rotational angle signal generated by the detection means when the throttle valve is in a fully closed position.

17. The throttle control device as in claim 16, wherein the sensor output signal is generated according to the relationship "V=Em*N+e−e0", wherein N is an integer number representing the number of detecting range cycles the motor, wherein Em is a number representing the maximum value of the incremental rotational angle signal, wherein e is a value representing the incremental rotational angle signal, and wherein e0 is a value representing the incremental rotational angle signal when the throttle valve is in the fully closed position.

18. The throttle control device as in claim 15, wherein:

the movable section of the sensor includes a pair of magnets positioned so as to oppose each other across the rotational axis of the motor; and the fixed sensing section includes a detecting section, a first computing section and a second computing section, and the rotation detection means is constituted by the detecting section and the first computing section, and the adding means and the subtracting means are constituted by the second computing section, and the detection section is positioned between the magnets and arranged and constructed so as to output a detecting signal corresponding to a change of direction of the magnetic field as the movable section rotates, and the first computing section generates the incremental rotational angle signal based upon the detecting signal from the detection section, the second computing section generates the sensor output signal based at least upon the rotational angle signal.

19. A sensor as in claim 18, wherein the first computing section and the second computing section are combined as an integrated circuit.

20. A throttle control device comprising:

a throttle body defining an intake air channel;

a throttle valve disposed within the intake air channel;

a motor having a rotary shaft rotatable about a rotational axis;

a speed reduction mechanism coupled between the motor and the throttle valve, so that the throttle valve is rotated by the motor via the speed reduction mechanism, a sensor arranged and constructed to detect a rotational position of the motor, the sensor comprising:

a movable section attached to the rotary shaft of the motor, so that the movable section rotates as the rotary shaft rotates, comprising:

a tubular member centered on the rotational axis of the motor, and a pair of magnets attached to an inner wall of the tubular member, and wherein the pair of magnets are positioned so as to oppose each other across the rotational axis of the motor; and wherein the pair of magnets are positioned so as to generate a magnetic field represented by substantially uniform magnetic field lines across a fixed sensing section, and the fixed section, and wherein the fixed sensing section interacts with the movable section and is mounted to the throttle body; and wherein the fixed sensing section is positioned between the magnets and arranged and constructed so as to detect the change of direction of the magnetic field as the movable section rotates, indicating the rotational position of the motor, and wherein a rotational position of the throttle valve is computed by the fixed sensing section using the rotational position of the motor and a speed reduction ratio of the speed reduction mechanism, and wherein an output signal is generated by the fixed sensing section indicating the rotational position of the throttle valve.

21. A sensor for use with a throttle control device which includes a throttle body defining an intake air channel, a throttle valve disposed within the intake air channel, a motor, and a speed reduction mechanism coupled between the motor and the throttle valve, so that the throttle valve is rotated by the motor via the speed reduction mechanism, the sensor comprising:

a rotational angle detection means generating an incremental rotational angle signal that changes linearly from a minimum value to a maximum value within a detection range equal to or less than one revolution of the motor in response to an increase of rotational angle of the motor, wherein the incremental rotational angle signal decreases from the maximum value to the minimum value as the rotational angle of the motor increases, after the rotational angle representing signal equals the maximum value, and wherein the incremental rotational angle signal increases linearly from the minimum value to the maximum value in response to further increase of the rotational angle of the motor; and an adding means, and a subtracting means, and wherein the adding means and the subtracting means generating a sensor output signal based upon the incremental rotational angle signal; and wherein the adding means operates to generate the sensor output signal by adding a value corresponding to the maximum value of the incremental rotational angle signal to the sensor output signal when the incremental rotational angle signal equals the maximum value during the rotation of the motor in a forward direction; and wherein the subtracting means operates to generate the sensor output signal by subtracting the value corresponding to the maximum value of the incremental rotational angle signal from the previous sensor output signal when the incremental rotational angle signal equals the minimum value during the rotation of the motor in a reverse direction.

22. The sensor as in claim 21, further including means for storing a reference value of the incremental rotational angle signal, wherein the reference value corresponds to the incremental rotational angle signal generated when the throttle valve is in a fully closed position.

23. The sensor as in claim 22, wherein the sensor output signal is generated based upon the relationship "V=Em*N+e−e0", wherein N is an integer number of representing the number of detecting range cycles of the motor, wherein Em is the maximum value of the incremental rotational angle signal, and wherein e is a value representing the incremental rotational angle signal, and wherein e0 is the reference value.

24. The sensor as in claim 21, further including:

a movable section attached to a rotary shaft of the motor, so that the movable section rotates as the rotary shaft rotates, and a fixed sensing section interacting with the movable section and mounted to the throttle body; and wherein the movable section of the sensor includes a pair of magnets positioned so as to oppose each other across the rotational axis of the motor; and wherein the fixed sensing section includes a detecting section, a first computing section and a second computing section, and wherein the rotation detection means is constituted by the detecting section and the first computing section, and wherein the adding means and the subtracting means are constituted by the second computing section, and wherein the detection section is positioned between the magnets and arranged and constructed so as to output a detecting signal corresponding to the change of direction of the magnetic field as the movable section rotates, and wherein the first computing section generates the incremental rotational angle signal based upon the detecting signal from the detection section, and wherein the second computing section generates the sensor output signal based at least in part upon the incremental rotational angle signal.

25. A sensor as in claim 24, wherein the first computing section and the second computing section are combined as an integrated circuit.

* * * * *